United States Patent [19]

Liebel

[11] Patent Number: 4,995,512

[45] Date of Patent: Feb. 26, 1991

[54] INTERIOR CORE PROTECTOR

[75] Inventor: Henry L. Liebel, Cincinnati, Ohio

[73] Assignee: Shippers Paper Products Company, Loveland, Ohio

[21] Appl. No.: 533,460

[22] Filed: Jun. 5, 1990

[51] Int. Cl.[5] ..... B65D 85/66

[52] U.S. Cl. ..... 206/396; 206/416; 206/586

[58] Field of Search ..... 206/413, 414, 415, 416, 206/303, 586, 395, 396, 397, 403, 389

[56] References Cited

U.S. PATENT DOCUMENTS

| | | | |
|---|---|---|---|
| Re. 30,168 | 12/1979 | Mason | 206/413 |
| 542,728 | 7/1895 | Duval | 206/414 |
| 1,377,154 | 5/1921 | Flynn | 206/415 X |
| 1,772,850 | 8/1930 | Wheldon | 206/414 |
| 1,989,182 | 1/1935 | Blake | 206/414 |
| 1,989,183 | 1/1935 | Blake | 206/414 |
| 2,101,355 | 12/1937 | Wonder | 206/303 X |
| 2,155,312 | 4/1939 | Houtzaager | 206/415 |
| 2,435,093 | 1/1948 | Mitschrich | 206/413 X |
| 2,883,045 | 4/1959 | Abramson | 206/396 |
| 2,943,732 | 7/1960 | Kovaleski et al. | 206/303 X |
| 3,332,601 | 7/1967 | Frank | 229/23 BT |
| 3,875,617 | 4/1975 | Cline | 248/499 X |
| 3,878,940 | 4/1975 | Wittebort | 206/416 |
| 3,942,638 | 3/1976 | Stone | 206/416 |
| 4,513,864 | 4/1985 | Liebel | 206/396 |
| 4,516,892 | 8/1990 | Curro, Jr. | 206/413 X |

FOREIGN PATENT DOCUMENTS 243453 11/1925 United Kingdom .

*Primary Examiner*—Paul T. Sewell
*Assistant Examiner*—Jacob K. Ackun, Jr.
*Attorney, Agent, or Firm*—Wood, Herron & Evans

[57] ABSTRACT

An interior core protector for positioning about the inner circumference of a coil of material having a core to protect the material from damage including a rigid preformed angle bendable into an annulus having a diameter approximating the diameter of the core and an annular retaining disk having right angle legs in which the preformed angle is retained. The disk with annular preformed angle therein are receivable in the core of the coil of material providing protection to the coil about its entire circumference.

9 Claims, 3 Drawing Sheets

INTERIOR CORE PROTECTOR

BACKGROUND OF THE INVENTION

This invention relates to an interior core protector and, more particularly, to the protection of the interior material in a roll of coiled material, for example, a coil of sheet steel.

It is well known that sheet steel, e.g., that which is used extensively in the automobile industry, is placed in large coils by the steel producer for shipment to the user. These coils weigh upwards to 15 tons and include a center core or opening therethrough. It is quite common in strapping of the coil to prevent its uncoiling to place steel straps through the center core and about the outside of the coil. Typically, at least two and sometimes three or four of these straps spaced about the coil are used. Furthermore, it is quite common in the transport of these heavy coils, particularly in their loading and unloading from trucks and railway cars, to use a C-hook which comes down and passes through the center core and is then raised to engage the interior surface of the material to lift the coil on and off the truck or railway car. In doing so, the C-hook often damages the metal particularly by bending of the edges of the material located at the center of the coil. That is, when the C-hook is placed through the coil and raised upwardly into engagement with the material, it is rare that the hook ever engages the material at both edges with equal pressure. Rather, the hook typically first engages one edge and then the other. When this happens, the pressure of the hook on the material causes its bending. This bent material, of course, is not usable and must be scrapped. It is not uncommon for the user to have to scrap 30 to 50 feet of the sheet metal because of such damage.

In addition to damage by the C-hook in loading and unloading of the coil material, it is also quite common for the transporter to throw a chain through the interior core of the coil to secure the coil on a truck or railway car. This likewise causes damage to the edges of the material causing waste and scrap of what would otherwise be usable material.

Thus, there was a need for an interior core protector for positioning about the inner diameter of a roll of coiled material to protect the material from damage that was relatively economic to produce, that provided full protection for the material about the 360° circumference of the interior core, and that provided advantages in terms of economic use of materials and economies of shipping to the customer.

In my U.S. Pat. No. 4,513,864, I provided an interior core protector including a pair of overlapping formed angular paperboard members which were manufactured in a flat, i.e., non-arcuate configuration. One leg of each of the members included a series of cuts spaced along its length and extending from the free edge of the leg to the angle joining the legs. These cuts permitted bending of the core protector to conform to the inner diameter of the coil. The cuts in the legs of one of the members was offset with respect to the cuts in the other member such that when the protector was bent to conform to the inner diameter of the coil and the spacing along each cut correspondingly increased, i.e., the cut opened up when the protector was bent, there was nevertheless provided a section of paperboard material overlapping each cut. The core protector thus provides protection for the material about the complete circumference of the inner core of the coil. Thus, when a chain was thrown through the core or a C-hook passing through the coil engaged the material, the edges of the inner length of the material were protected from damage. No special locating or positioning of the C-hook, for example, was needed. Rather, since 360° protection to the edges of the material at the inner core was provided, the coil could be grasped at any location.

It has been found, however, that in some applications it is desirable to have a more rigid core protector which will more firmly seat in the core of the coil and not be subject to dislodging therefrom. Such a core protector in addition must offer the advantages of providing the coiled material with protection including protection to the edges of the inner length of material around the entire circumference of the core, economy of materials of construction, economic use of this material in that there is very little waste in forming the protector, and economies of packaging and shipping whereby the components of the core protector may be shipped merely by stacking up a series of protectors one on another and shipping them in a flat or non-arcuate configuration thus resulting in full utilization of shipping capacity with no waste of space.

To this end, the core protector of the present invention is adapted for positioning about the inner diameter of coiled material to protect the material from damage about its entire inner circumference, is relatively economic to produce, provides full protection for the material about the 360° circumference of the core, provides advantages in terms of economic use of materials and economies of packaging and shipping to the customer, and is more rigid for placement and retention within the core of the coil.

In a presently preferred form of the invention, the interior core protector includes two elements. One is a rigid preformed angle having first and second legs generally at right angles to one another. The first leg is bendable into an annulus during assembly of the core protector. The second leg has a plurality of spaced cuts in it extending from the apex of the angle to the outer edge thereof. These cuts permit bending of the angle to conform to the inner diameter of the core with the spacing between each cut increasing or opening up as the angle is bent into an annulus. The other member is an annular retainer disk having an inner diameter, an outer diameter, and an intermediate diameter therebetween defining an annular fold line equal in diameter substantially to the diameter of the annulus formed by the preformed angle. The disk has a plurality of spaced cuts therein extending from the inner diameter to the intermediate diameter and is receivable on the first leg of the angle when it is bent into an annulus. On assembly, the material between the spaced cuts in the disk are folded 90° and lie against the first leg of the angle. The remaining material between the intermediate diameter and outer diameter in turn lies against the second leg of the angle so that when the interior core protector is positioned in a core of material the space between each cut in the second leg of the angle is covered by the disk, and the spaces between each cut in the disk is covered by the first leg of the angle to provide complete protection for the coil of material around substantially the entire circumference of the coil. The annular retainer disk serves to firmly position the preformed angle annulus in place.

Preferably the preformed angle is formed of multiple plies of paperboard that are laminated, glued, treated, and formed into a rigid right angle. The annular retaining disk is preferably formed of double-walled corrugated. In packaging and shipping, the preformed angles are stacked one upon another and shipped in a straight or non-arcuate condition. Likewise, the annular retaining disks are stacked upon one another and shipped in a flat stacked condition. The core protector can be quickly and easily assembled at the customer's site by bending the preformed angle into an annulus and inserting it into the retaining disk whereupon the preformed angle expands the segments of the retaining disk between the inner diameter and intermediate diameter and forces them to a position perpendicular to the remainder of the disk.

Thus, the present invention provides a rigid interior core protector which is economically manufactured and economically packaged and shipped.

FIGS. *7a–d* is a schematic showing a method of assembly of the core protector.

DETAILED DESCRIPTION OF THE INVENTION

Figure 1:
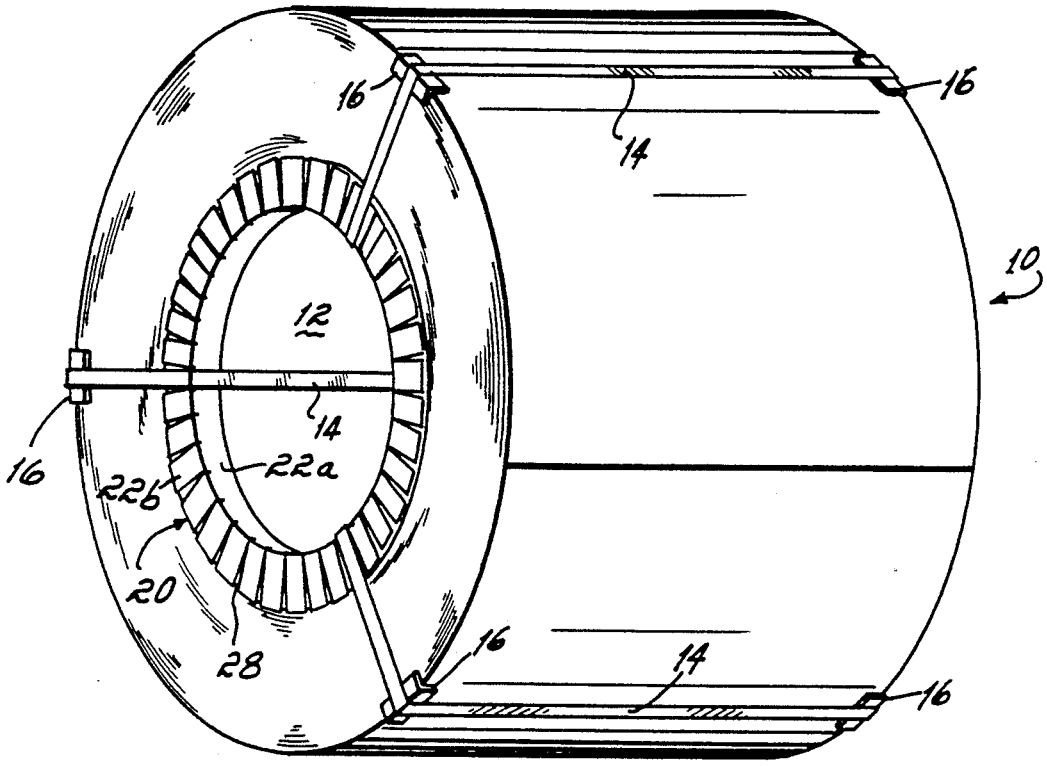
FIG. 1 is a perspective view showing the interior core protector of the present invention positioned within a coil of sheet steel.
Figure 3:
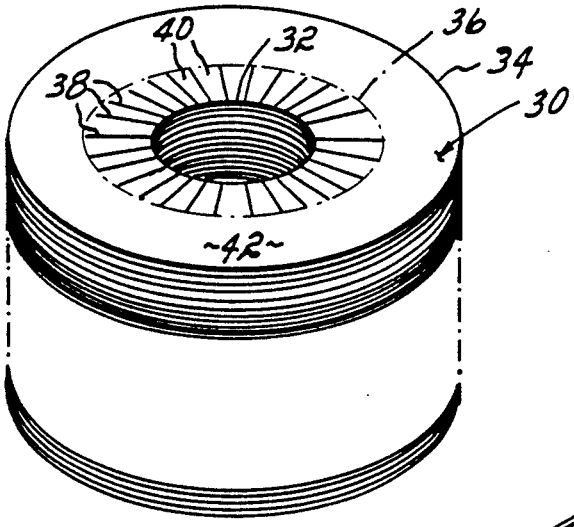
FIG. 3 is a perspective view showing stacking of the annular retainer disks for shipment.
Figure 2:
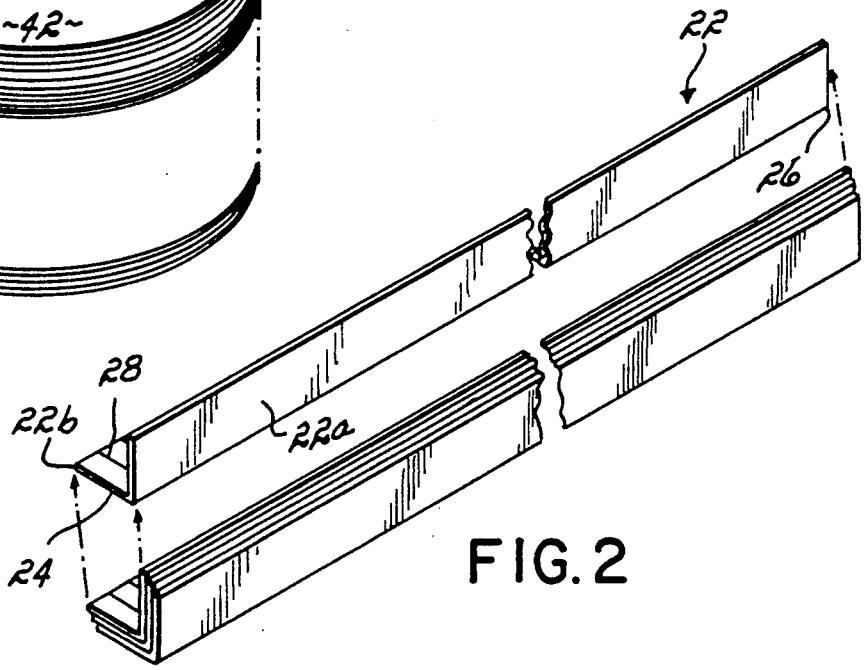
FIG. 2 is a perspective view showing stacking of the preformed angles for shipping.

Referring to FIG. 1, there is shown a coil of sheet material 10, for example, a large and heavy coil of sheet steel of the type typically used in the automobile industry, for purposes of illustrating the environment in which the present invention finds particular applicability. As shown in FIG. 1, the sheet material is coiled to form a large roll of material having an open center core 12. A series of steel bands 14 are placed through the core 12 and about the coiled material to keep the material from uncoiling. As is common practice in the industry, paperboard angles 16 are provided on the outer diameter of the coil 10 to keep the edges of the sheet steel from cutting the steel straps. The interior core protector 20 of the present invention is adapted to be placed about the inner core 12 of the coil 10 on both sides of the coil, i.e., two coil protectors are used for each coil. Thus, when the coil protectors 20 are positioned in the core 12 of the coil 10 as shown in FIG. 1, the protectors 20 form a protective barrier around the inner edges of the coiled material. Referring now to FIGS. 2 and 3, the core protector is formed of two elements. One is a rigid preformed angle 22 having a first leg 22*a* and a second leg 22*b* generally at right angles one to another and a pair of opposed ends 24, 26. The preformed angle 22 is preferably formed of a relatively inexpensive material such as multiple plies of paperboard that are laminated, glued, treated, and formed into rigid right angles. A presently preferred thickness of the preformed angle is on the order of 0.160 to 0.400 inches. One leg 22*b* of the angle is die cut to provide a series of generally equally spaced cuts 28 extending from the outer edge of the leg to the angle at which the two legs 22*a*, 22*b* meet. As will be seen with reference to FIG. 4, the die cuts 28 permit the angle 22 to be bent into a generally circular or annular configuration whereby the opposed ends 24, 26 may be brought into proximity one with the other.

Figure 4:
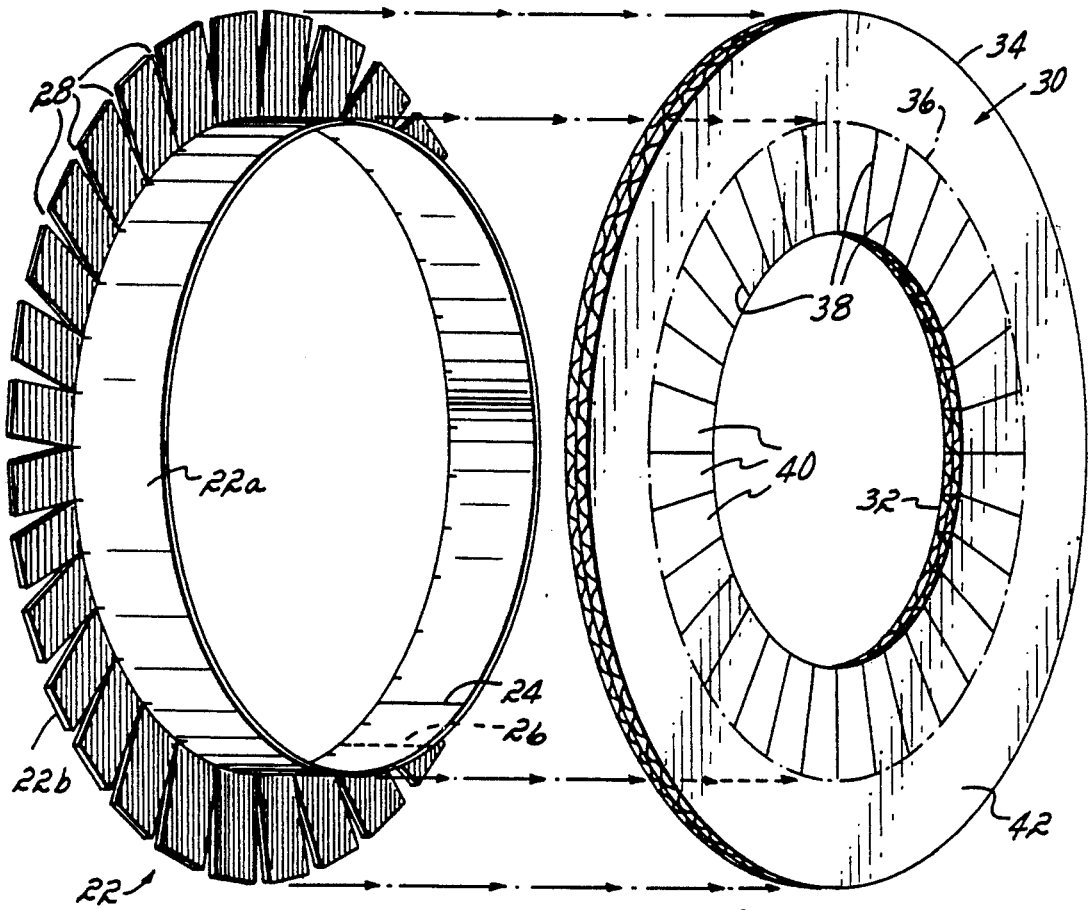
FIGS. 4 and 5 are exploded perspective views showing assembly of the interior core protector.

In a presently preferred form of the invention, the preformed angle is about 75 inches long to cover the circumference of a 24 inch diameter core and each leg 22*a*, 22*b* is approximately 3 inches wide. Thus, when the angle is bent to conform to the diameter of the core 12 as shown in FIG. 4, an annulus having right angle legs 22*a*, 22*b* approximately 3 inches wide on each angle are formed with the leg 22*b* having the die cuts facing radially outward along the face of each side of the coil (FIG. 1).

As shown in FIG. 2, the preformed angles 22 are stackable in a flat or unbent condition whereby a number of angles can be shipped in a compact package for assembly and use.

Referring now to FIG. 3, the other element of the core protector is an annular retaining disk 30 having an inner diameter 32, an outer diameter 34, and an intermediate diameter 36 therebetween defining an annular fold line. The annular fold line 36 is located so as to be equal in diameter substantially to the diameter of the core 12 and of the annulus formed by the first leg 22*a* of the rigid preformed angle 22. The disk 30 has a plurality of spaced cuts 38 therein extending from the inner diameter 32 to the intermediate diameter 36 defining a plurality of adjacent die cut sections 40. The disk 30 is preferably formed of double wall corrugated 350 pound test and has a thickness on the order of ⅜ inch. The outer diameter 34 of the disk 30 maybe any diameter desired up to the outer diameter of the coil of material 10.

As may be seen in FIG. 3, a number of disks 30 are shipped in a stacked condition again achieving substantial economies of packaging and shipping.

Figure 5:
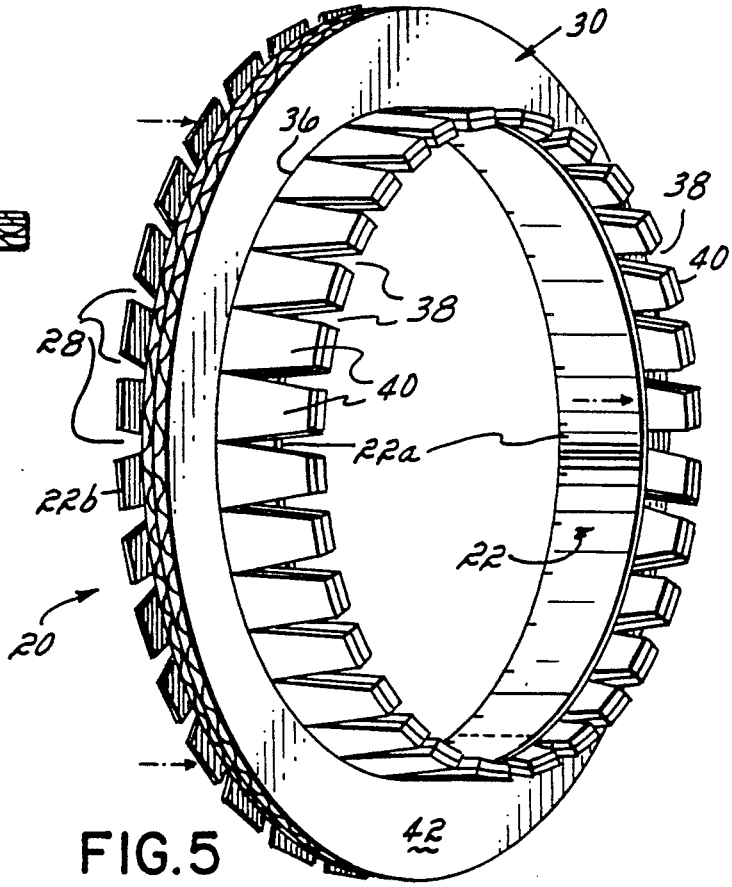

Referring now to FIGS. 4 and 5, when it is desired to assemble the core protector, one rigid angle 22 from the stack shown in FIG. 2 is removed and bent into an annulus to bring the opposed ends 22*a*, 22*b* of the angle 22 into proximity of each other. Overlap of the ends 22*a*, 22*b* is permitted. The bending of the angle causes the spaces 28 between the die cut sections in the leg 22*b* to increase or widen. The annular angle 22 is then inserted into the disk 30. Since the diameter of the annulus equals substantially the intermediate diameter 36 of the disk 30, insertion of the annular angle 22 causes the die cut sections 40 of the disk to bend to a position at right angles to the uncut section 42 of the disk (FIG. 5). As such, the spaces 38 between the die cut sections 40 increase or widen with this movement. As may be seen by reference to FIG. 5, those spaces 38, however, overlay the uncut leg 22*a* of the preformed angle 22. Likewise, the spaces 28 in the die cut leg 22*b* of the preformed angle 22 are underlied by the uncut portion 42 of the disk 30. As such, the core protector 20 can be placed in the core 12 of the coil of material 10 without any exposure of the material 10 to means such as a C-hook or a hold-down chain passing through the core thus providing full protection to the edges of the inner length of core material about the full circumference of the inner core. Thus, the core protector provides for complete protection along the entire 360° circumference of the core, and the C-hook can therefore enter the core from any position about the core.

One of the advantages of the present invention is that when the rigid angle 22 is inserted in the annular retainer disk 30, the resiliency of the corrugated material retains the angle 22 in its annular configuration thus providing it with increased rigidity. Thus, the core protector 20 can be inserted into the core 12 and tightly engage the material about the inner core 12. Thus, there is no need for any special provision for either locating or holding the core protector 20 in position while strapping the coil. However, although the preformed angle 22 is relatively stiff, it may nevertheless be desired to tack weld some or all of the die cut sections of leg 22*b* to the uncut section 42 of the disk 30, for example, by means of a hot melt adhesive or other glue. In addition, the core protector 20 is made of a formed angular paperboard member 22 and a double wall corrugated disk 30 and thus is relatively inexpensive to make. Further, there is relatively little waste of material and particular economies are realized in stacking and shipping the core protector components 22, 30.

Figure 6:
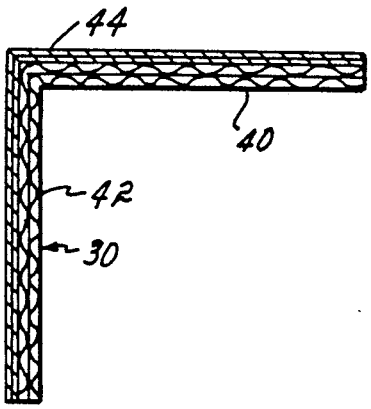
FIG. 6 is a cross-section of an alternative embodiment of the core protector.

Referring to FIG. 6, the corrugated annular retaining disk 30 can be provided with a surface of increased strength, puncture resistance, and abrasion resistance by laminating to the outer face of it additional layers of solid fiber paperboard such as two layers of 69 pound linerboard 44 having a total thickness on the order of 0.036 to 0.040 inches.

Figure 7A:
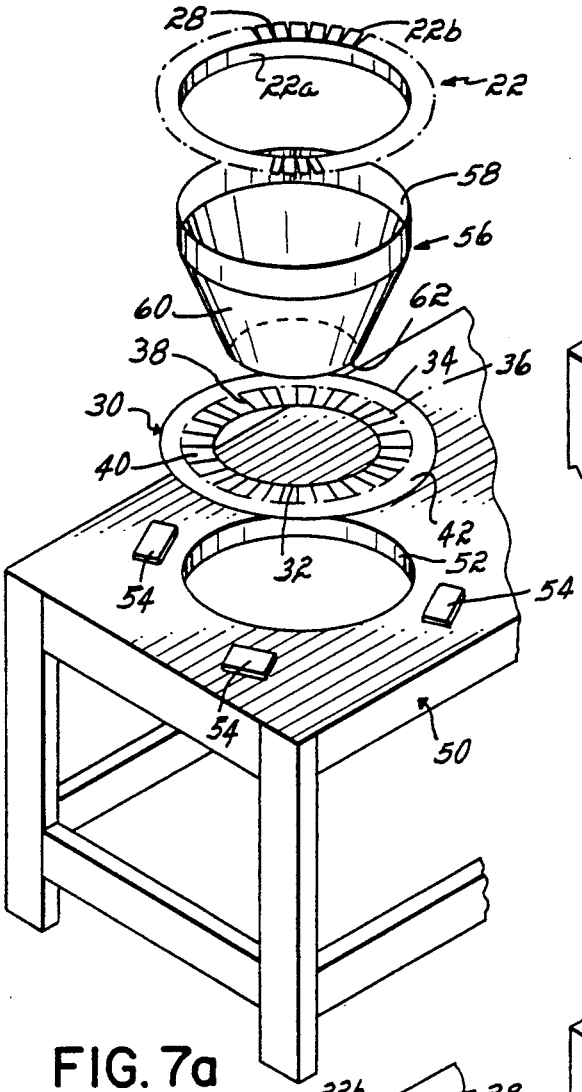
Figure 7B:
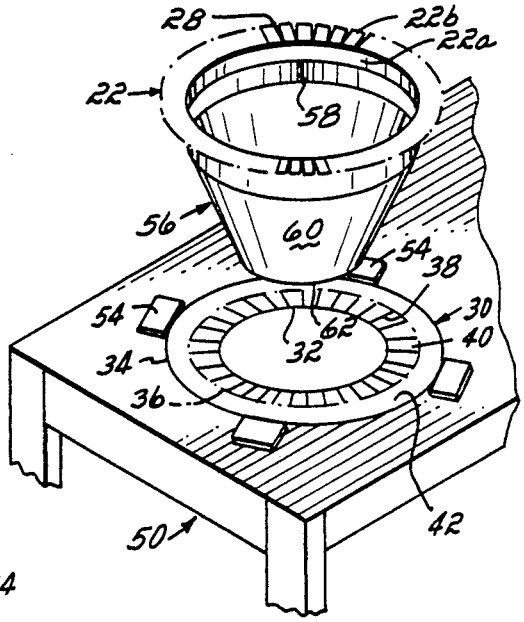
Figure 7C:
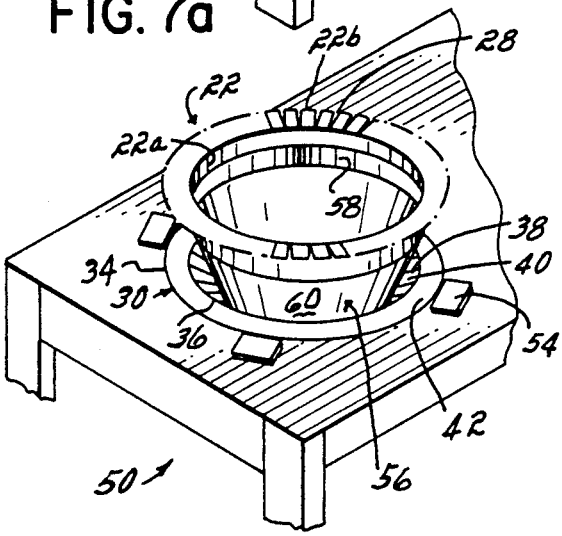
Figure 7D:
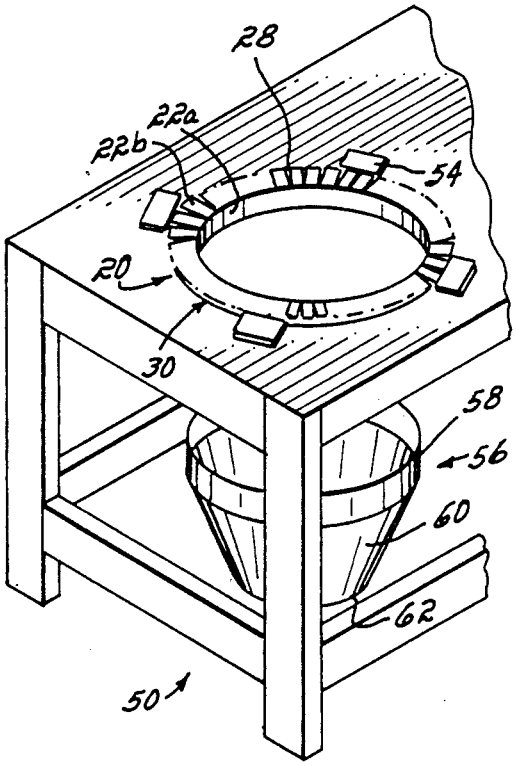

A particularly convenient method for assembling the core protector is illustrated in FIG. 7*a–d*. The annular retaining disk 30 is placed on a fixture 50 having an opening 52 equal generally to the intermediate diameter 36 of the disk 30. Locaters 54 center the disk 30 over the fixture opening 52. A metal or plastic assembly funnel 56 has a cylindrical section 58 having a diameter equalling slightly less than the intermediate diameter 36 and a frustoconical section 60 having a smaller diameter at one end 62 generally smaller than the inner diameter 32 of the disk 30. The preformed angle 22 is bent into an annulus and placed inside the cylindrical section 58 of funnel 56 (FIG. 7*b*). Since the cylindrical section 58 has substantially the same inside diameter as the intermediate diameter 36 of the disk 30, the preformed angle 22 is conveniently configured in its annular dimension. The funnel 56 is then passed through the inner diameter 32 of the retainer disk 30 (FIG. 7*c*). As the assembly funnel 56 passes therethrough, the die cut sections 40 ride up the conical section 60 and are caused to expand outwardly and downwardly in opening 52 in a direction ultimately perpendicular to the uncut section 42 of the disk 30. At this position, the cylindrical section 58 of the funnel 56 engages the material at the intermediate diameter 36 causing the die cut sections 40 of the disk 30 to be at right angle to the uncut section 42. As the funnel 56 continues to pass through the disk 30, the preformed angle 22 lodges in position in the disk 30 with the die cut leg 22*b* contacting the uncut annulus 42 of the disk 30, and the uncut section 22*a* of the angle 22 lying interiorly of the die cut section 40 of the disk 30. The funnel 56 having a relatively thin wall continues to pass through the opening 52 leaving the angle 22 behind in assembled position in the retainer disk 30. The core protector 20 is then easily lifted off the fixture 50 and inserted in the core 12 of the coil of material 10.

Although the presently preferred form of the invention presently utilizes paperboard and corrugated as the materials of the construction for the reasons stated above, it will be appreciated that other materials such as sheet steel or other metal may be used if so desired.

Thus having described the invention, what is claimed is:

1. An interior core protector for positioning about the inner circumference of a coil of material having a core to protect the material from damage, comprising:

a rigid preformed angle having a first leg and a second leg generally at right angles one to another and a pair of opposed ends, said first leg being bendable whereby said opposed ends may be brought together to form an annulus, said second leg having a plurality of spaced cuts therein extending from the apex of said right angle to the outer edge thereof, the length of said angle being such that the diameter of said annulus is substantially at least as great as the diameter of the core, the spaces between said cuts in said second leg widening on bending of said first leg permitting bending of said angle to conform to the circumference of the core, an annular retainer disk having an inner diameter, an outer diameter, and an intermediate diameter therebetween, said intermediate diameter defining an annular fold line equal in diameter substantially to the diameter of the annulus formed by said first leg of said rigid preformed angle and substantially to the diameter of said core, said disk having a plurality of spaced cuts therein extending from said inner diameter to said intermediate diameter, said disk being receivable on said first leg of said preformed angle when said first leg is bent to an annulus, the material between said spaced cuts in said disk being folded to a right angle to lie against said first leg of said angle, the material between said intermediate diameter and said outer diameter lying against said second leg of said angle so that when said interior core protector is operatively positioned in a coil of material the space between each cut in said second leg of said angle is covered by said disk and the space between each cut in said disk is covered by said first leg of said angle to provide protection for the coil of material around substantially the entire circumference of the core.

2. The interior core protector of claim 1 wherein said preformed angle is formed of paperboard and said retainer disk is formed corrugated.

3. The interior core protector of claim 2 wherein the thickness of the preformed angle is in the range of 0.160 to 0.400 inches.

4. The interior core protector of claim 1 further characterized in that said preformed angle and said retainer disk are storable and shipable in an unbent condition, said preformed angle being bendable to conform to the circumference of the core of the coil with which it is used, and said disk being shipable in a flat stacked condition with said material between said inside diameter and said intermediate diameter being bendable to receive said angular annulus therein.

5. The interior core protector of claim 1 wherein the radial distance between said intermediate diameter and said outer diameter of said annular retaining disk is equal generally to the width of said second leg of said preformed angled.

6. The interior core protector of claim 1 wherein the radial distance between said intermediate diameter and said outer diameter of said annular retainer disk is greater than the width of said second leg of said preformed angle but less than or equal to the outer diameter of said coil of material.

7. The interior core protector of claim 1 wherein said annular retaining disk further includes laminated on one face thereof at least one layer of linerboard.

8. The interior core protector of claim 7 comprising two layers of linerboard laminated to said disk having a total thickness in the range of 0.036 to 0.040 inch.

9. An interior core protector for positioning about the inner circumference of a coil of material having a core to protect the material from damage, comprising:

a rigid preformed angle having a first leg and a second leg generally at right angles one to another and a pair of opposed ends, said first leg being bendable whereby said opposed ends may be brought together to form an annulus, said second leg having a plurality of spaced cuts therein extending from the apex of said right angle to the outer edge thereof, the length of said angle being such that the diameter of said annulus is substantially at least as great as the diameter of the core, the spaces between said cuts in said second leg widening on bending of said first leg permitting bending of said angle to conform to the circumference of the core, an annular retainer disk having an inner diameter, an outer diameter, and an intermediate diameter therebetween, said intermediate diameter defining an annular fold line equal in diameter substantially to the diameter of the annulus formed by said first leg of said rigid preformed angle and substantially to the diameter of said core, said disk having a plurality of spaced cuts therein extending from said inner diameter to said intermediate diameter, said disk being receivable on said first leg of said preformed angle when said first leg is bent to an annulus, the material between said spaced cuts in said disk being folded to a right angle to lie against said first leg of said angle, the material between said intermediate diameter and said outer diameter lying against said second leg of said angle so that when said interior core protector is operatively positioned in a coil of material the space between each cut in said second leg of said angle is covered by said disk and the space between each cut in said disk is covered by said first leg of said angle to provide protection for the coil of material around substantially the entire circumference of the core, said rigid preformed angle having sufficient rigidity such that when said preformed angle is operably positioned in said annular retainer disk said first leg lies against said annular retaining disk between said inner diameter and said intermediate diameter and said second leg lies against said annular retainer disk between said intermediate diameter and said outer diameter, said legs having sufficient resiliency such that when bent to form said annulus said first leg tends to expand outwardly in said annular retainer disk thereby holding said preformed angle against the intermediate diameter of said annular retaining disk and said second leg lies against said annular retaining disk on the face of said coil of material.

* * * * *